US007451701B2

(12) United States Patent
Garner

(10) Patent No.: US 7,451,701 B2
(45) Date of Patent: Nov. 18, 2008

(54) FLARE SECURING SYSTEM

(76) Inventor: Thomas L. Garner, 24752 Via Larga, Laguna Niguel, CA (US) 92677

( * ) Notice: Subject to any disclaimer, the term of this patent is extended or adjusted under 35 U.S.C. 154(b) by 153 days.

(21) Appl. No.: 11/326,662

(22) Filed: Jan. 5, 2006

(65) Prior Publication Data

US 2007/0163458 A1 Jul. 19, 2007

(51) Int. Cl.
*F42B 4/26* (2006.01)

(52) U.S. Cl. ..... 102/343; 102/345; 102/358; 102/360; 248/513

(58) Field of Classification Search ..... 102/343, 102/344, 345, 336, 358, 360; 248/512, 513
See application file for complete search history.

(56) References Cited

U.S. PATENT DOCUMENTS 3,363,560 A * 1/1968 McBride ..... 102/343
3,678,856 A * 7/1972 Barocca et al. ..... 102/343

FOREIGN PATENT DOCUMENTS

JP 2089587 7/1990

* cited by examiner

*Primary Examiner*—James S Bergin
(74) *Attorney, Agent, or Firm*—Niky Economy Syrengelas, Esq.; Crockett & Crockett

(57) ABSTRACT

A system for the securing of road flares in order to maintain continuous burning of the flares and not allow them to roll away. The system includes first and second holding means aligned either in the same plane, or offset from each other. The first holding means holds a flare by a first end of the flare. The second holding means is connected to the first holding means in either the same plane or else at a distance from the first holding means. The second holding means holds a second flare by the second end of the flare. Once the first flare has burned the entire length of the flare, it ignites the second end of the second flare so that the second flare is ignited.

2 Claims, 2 Drawing Sheets

FLARE SECURING SYSTEM

FIELD OF THE INVENTION

The inventions described below relate to the field of securing systems for road flares.

BACKGROUND OF THE INVENTIONS

Flares are commonly used as temporary signals to mark the location of road hazards such as accidents, other emergency operations, construction, or just to call attention to a given situation. Flares are usually positioned at a distance behind the actual site of interest in order to give some advanced warning that the site is being approached. Police officers and other emergency personnel use flares to identify an accident area and must make an evaluation of the accident and determine how and where to lay flare patterns. Many times one flare is stacked on top of another to extend the burning time of the flare patterns. However, wind or terrain can cause the movement of a flare laid on the ground in this manner. This causes a dangerous situation where a lit flare may roll from its original position into flammable fluids discharged from vehicles. Though flares have been used for many years due to their visibility and flexibility in blocking off streets or directing traffic away from a traffic incident, there has not been a device that adequately secures from rolling off a stacked flare pattern. Thus emergency personnel must periodically monitor their flare patterns to ensure none of the flares have moved off the flare pattern stack and into any flammable liquids or other flammable material. Additionally, there has not been a device that allows for continuous burning of flares that burn for a short time span in order to prevent wasteful burning of long span flares. The new device and method described below has overcome these limitations.

SUMMARY

The device, system and method described below provide for the securing of road flares in order to maintain continuous burning of the flares. The device includes first and second or more tool clips or other suitable holding means. The tool clips are aligned either in the same plane, or they may be offset from each other. The tool clips are capable of engaging a flare and securing the flare. The first tool clip holds a flare by a first end of the flare. The second tool clip is connected to the first tool clip in either the same plane or at a distance from the first tool clip. The tool clip holds a second flare by a second end of the flare. Once the first flare has burned the entire length of the flare, it ignites the second end of the second flare so that the second flare is ignited.

The tool clip or holding means can be square, circular, rectangular or any other alternative shape that is capable of engaging the body of a flare. The fastening means can also have a raised portion to allow the securing device to position the flares at some distance off of the ground. This allows the flares to be seen at a farther distance than if they are merely placed on the ground.

DETAILED DESCRIPTION OF THE INVENTIONS

Figure 1:
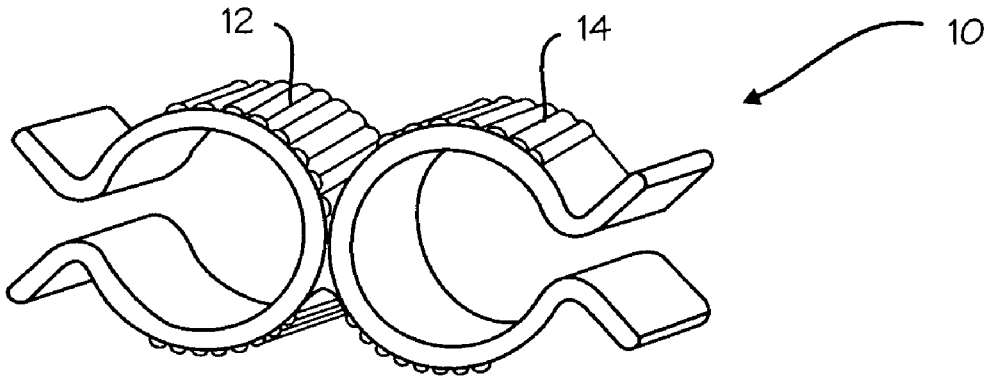
FIG. 1 illustrates a flare securing device.

FIG. 1 illustrates a flare securing device 10. The device includes first and second tool clips or holding means 12 and 14. In this configuration, the holding means 12, 14 are aligned in the same plane. The first and second holding means are capable of frictionally or elastically engaging the first and second flares. The clips may comprise substantially cylindrical sections with a diameter closely matching the typical flare as shown, or they may comprise any other form of a clip or holder.

Figure 2:
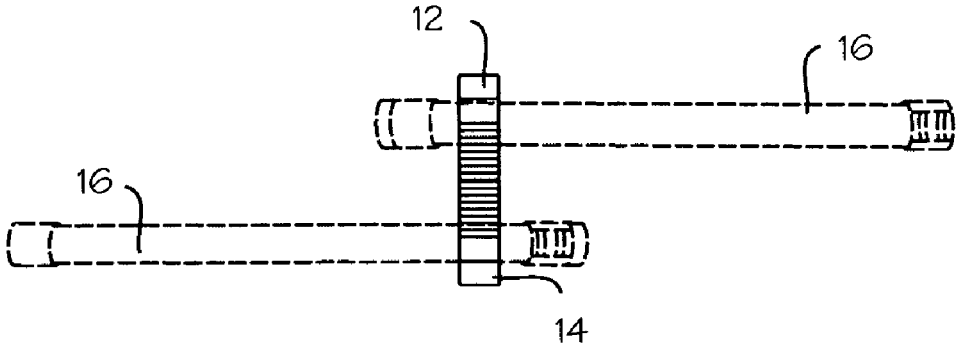
FIG. 2 illustrates the flare securing device of FIG. 1 in use.

FIG. 2 illustrates the flare securing device of FIG. 1. The holding means are each capable of engaging and securing a flare 16. The first holding means 12 holds a flare by a first end of the flare. The second holding means 14 is connected to the first holding means. The second holding means holds a second flare by a second end of the flare. Once the first flare has burned the entire length of the flare, it ignites the second end of the second flare so that the second flare is ignited.

Figure 3:
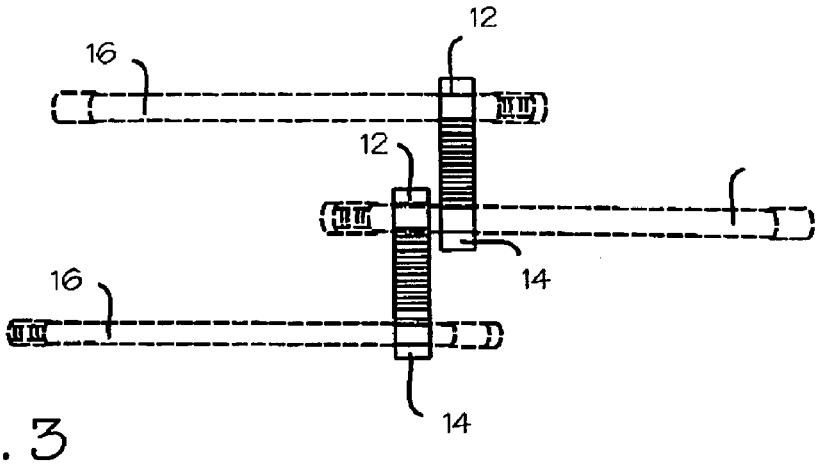
FIG. 3 illustrates multiple flare securing devices used with multiple flares to lift the flare off the ground.

FIG. 3 illustrates multiple flare securing devices used with multiple flares 16 to lift the flare of the ground. Three flares 16 are secured to each other via the use of two different securing devices. A first flare is commonly secured to second and third flares via the use of the two different securing devices. This configuration allows for a single flare to ignite multiple flares where a greater signal emission is required.

Figure 4:
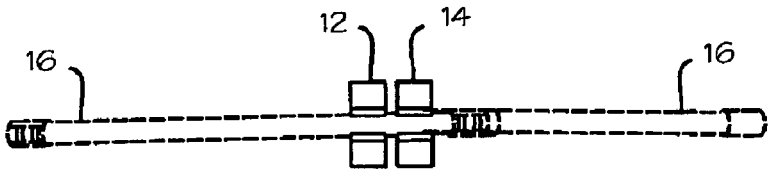
FIG. 4 illustrates a side view of FIG. 3 in use.

FIG. 4 illustrates a side view of FIG. 3. In this configuration, the first and second holding means are offset from each another. Each of the holding means is capable of containing and securing a flare. The first holding means 12 holds the flare by the first end of the flare. The second holding 14 means is connected to the first holding means and is offset from the first holding means (meaning the two holding means are not contained in the same plane). The second holding means holds the second flare by a second end of the flare.

Figure 5:
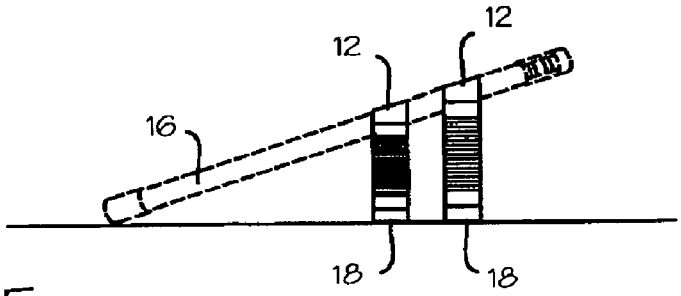
FIG. 5 illustrates a flare securing device that supports the flares off the ground.

FIG. 5 illustrates a flare securing device 10 that supports the tips of the flares 16 off the ground. The first and second holding means 12 and 14 contain a raised or inclined section 18. This section rests on the road or pavement and inclines the flare secured within it so that the flare tip does not come in direct contact with the ground. The advantage to this configuration is that it allows the flares to be seen at a farther distance than if they are merely placed on the ground. The first and second fastening means can be aligned in the same plane or else they can be offset from each other, as shown in FIGS. 2 and 3.

The holding means are sized and dimensioned to contain standard road flares. The holding means can be square, circular, rectangular or any other alternative shape that is capable of containing the body of a flare. The holding means are preferably constructed of any material that is capable of withstanding the heat emitted from the flare. The holding means contains a tensioned throat portion. The tensioned area allows the flares to be secure but is not so tensioned that a flare cannot open the tensioned area. Use of the flare securing device allows for secure locking of a number of flares together thereby preventing them from rolling away from their initial placement. Also, the flare securing device allows the shorter term road flares to be used without continual monitoring.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A flare securing system comprising: a first flare; a second flare; and a flare securing device for securing the first flare to the second flare consisting essentially of a first holding means with a tensioned throat portion for frictionally engaging the first flare, a second holding means with a tensioned throat portion for frictionally engaging the second flare and attached to the first holding means in an abutting relationship, wherein the first and second holding means are secured to each other in the same plane, said plane being perpendicular to the longitudinal axis of the first and second flares, wherein the tensioned throat portions of the first and second holding means are alone sufficient to frictionally secure the first and second flares in a parallel relationship.

2. The flare securing system of claim 1 wherein the first and second holding means are circular.

* * * * *